US006386782B1

(12) United States Patent
White, Sr.

(10) Patent No.: US 6,386,782 B1
(45) Date of Patent: May 14, 2002

(54) GROUT SEALER APPLICATOR

(76) Inventor: Dennis P. White, Sr., 3454 E. El Moro, Mesa, AZ (US) 85204

( * ) Notice: Subject to any disclaimer, the term of this patent is extended or adjusted under 35 U.S.C. 154(b) by 0 days.

(21) Appl. No.: 09/640,567

(22) Filed: Aug. 16, 2000

Related U.S. Application Data

(60) Provisional application No. 60/149,280, filed on Aug. 16, 1999.

(51) Int. Cl.[7] ..... B43M 11/02
(52) U.S. Cl. ..... 401/220; 401/219
(58) Field of Search ..... 401/208, 220, 401/219, 264, 48, 6

(56) References Cited

U.S. PATENT DOCUMENTS 2,029,056 A * 1/1936 Carlson ..... 401/208
2,732,575 A * 1/1956 Faust ..... 401/220
3,379,490 A * 4/1968 Schwartzman ..... 401/264
4,723,860 A * 2/1988 Giblin et al. ..... 401/219
5,934,816 A * 8/1999 Bruttomesso ..... 401/219

FOREIGN PATENT DOCUMENTS

GB 496670 * 12/1938 ..... 401/220

* cited by examiner

*Primary Examiner*—David J. Walczak
(74) *Attorney, Agent, or Firm*—Parsons & Goltry; Robert A. Parsons; Michael W. Goltry

(57) ABSTRACT

An applicator for a liquid grout sealer including an elongated tubular body defining a sealer reservoir, a sealer valve at an end of the tubular body including a spring normally biasing the sealer valve into a closed position and pressure activated by axial pressure on the tubular body into an open position against the bias of the spring, and an applicator wheel carried by the sealer valve for receiving sealer from the reservoir through the sealer valve in the open position and for distributing sealer.

9 Claims, 9 Drawing Sheets

GROUT SEALER APPLICATOR

CROSS-REFERENCE TO RELATED APPLICATION

This application claims the benefit of U.S. Provisional Application No. 60/149,280, filed Aug. 16, 1999.

FIELD OF THE INVENTION

This invention relates to applicators of grout sealer.

More particularly, the present invention relates to apparatus for applying liquid grout sealer to grout and the like.

BACKGROUND OF THE INVENTION

Grout is used in many applications, e.g. between floor tiles, wall tiles, etc. However, grout is relatively porous so that foreign materials can enter interstices, as well as residing on the surface, and stain the grout, which detracts from the appearance. Accordingly, the surface of the grout is generally sealed to prevent the foreign materials from entering. Generally, the grout sealer is in a liquid form which is applied by using a brush, rag, or other distribution device.

The problem with applying grout sealer using a brush or other prior art device is that it is very slow and messy. Applying the sealer to grout between floor tiles, for example, is very time consuming since one must use care to not get the sealer on the tile surfaces but should completely cover the grout between the tiles to ensure a proper seal against liquids and the like which can enter and stain the grout. Further, in the use of a brush or the like one must continually move the brush from a reservoir of the sealer (where the brush is loaded with sealer) to the grout. During this movement it is nearly impossible to not drip sealer on the tiles and on any other surfaces which are present. Also, the thickness of the sealer can vary substantially when it is applied by brush, which can result in quicker wear of the sealer, a poorer seal in thin areas, and different colors of seal when comparing the thicker areas to thinner areas.

It would be highly advantageous, therefore, to remedy the foregoing and other deficiencies inherent in the prior art.

Accordingly, it is an object of the present invention to provide a new and improved applicator for a liquid grout sealer.

Another object of the invention is to provide a new and improved applicator for a liquid grout sealer which is easy and efficient to use.

And another object of the invention is to provide a new and improved applicator for a liquid grout sealer which provide a uniform and clean application of grout sealer.

Still another object of the present invention is to provide a new and improved applicator for a liquid grout sealer with built in reservoir of sealer which is easy to use and which can be distributed uniformly.

A further object of the invention is to provide a new and improved applicator for a liquid grout sealer which can quickly and easily seal various widths of grout.

Yet another object of the invention is to provide a new and improved applicator for a liquid grout sealer which provides adequate channeling of the sealer from a reservoir without dripping and puddling.

SUMMARY OF THE INVENTION

Briefly, to achieve the desired objects of the instant invention in accordance with a preferred embodiment thereof, provided is an applicator for a liquid grout sealer including an elongated tubular body, which operates as a sealer reservoir, with a pressure activated sealer valve at the lower end that only releases sealer when the user presses down on the applicator handle. The pressure activated sealer valve is spring loaded so that when pressure is released the valve is closed and no sealer can flow. The pressure activated sealer valve provides sealer directly to an applicator wheel which has axially extending slots around the periphery which distributes the sealer evenly and accurately without dripping or puddling.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
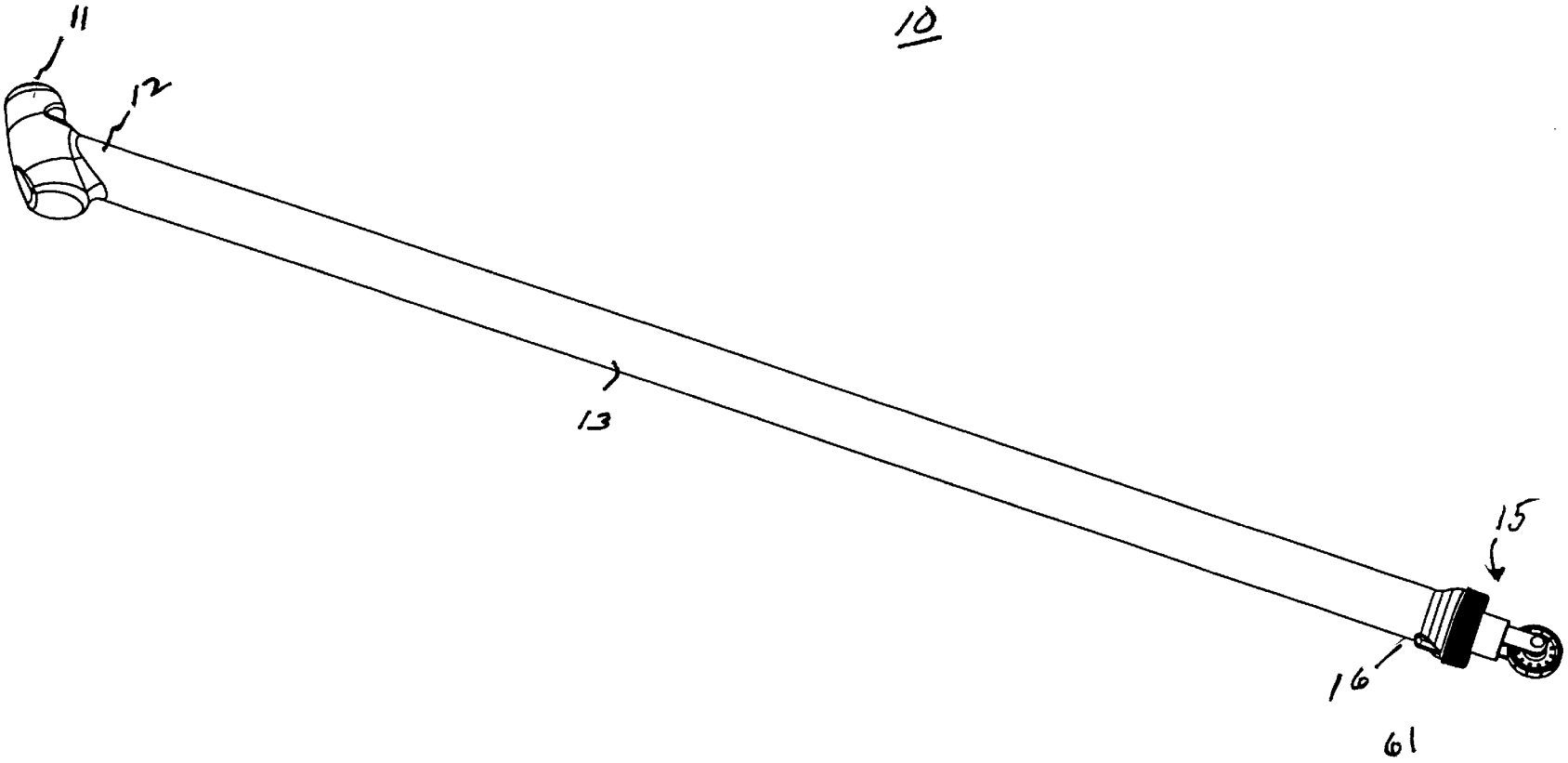
FIG. 1 is an isometric view of an applicator for grout sealer in accordance with the present invention.
Figure 2:
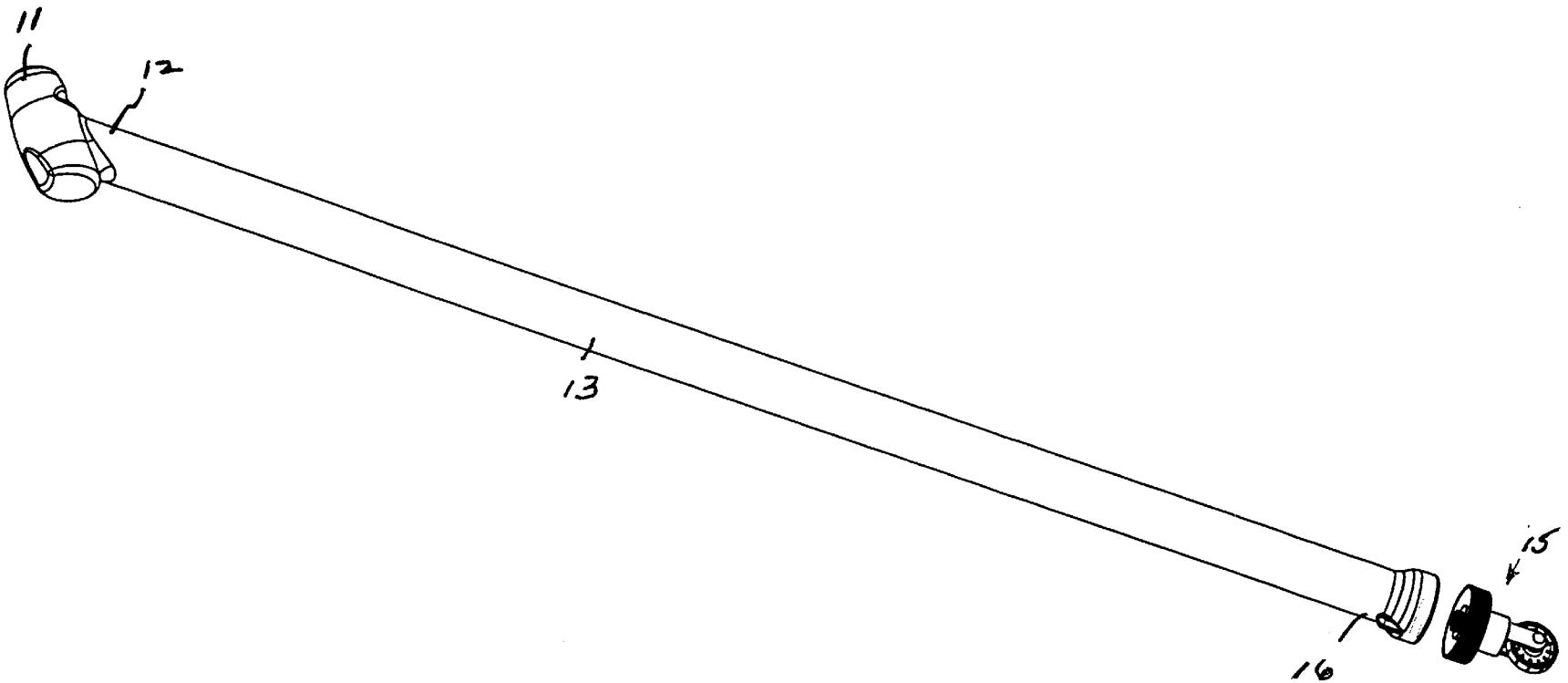
FIG. 2 is an isometric view of the applicator of FIG. 1 with a portion disassembled.

Turning now to the drawings in which like reference characters indicate corresponding elements throughout the several views, attention is first directed to FIG. 1 which illustrates an applicator 10 for grout sealer in accordance with the present invention. Applicator 10 includes a handle 11 affixed to an end 12 of an elongated tubular body 13. Tubular body 13 acts as a reservoir for liquid sealer which is to be applied to grout, for example grout between floor tiles. A pressure activated sealer valve 15 is threadedly engaged with a lower end 16 (opposite handle 11) of body 13, with FIG. 2 illustrating valve 15 unassembled from body 13.

Figure 3:
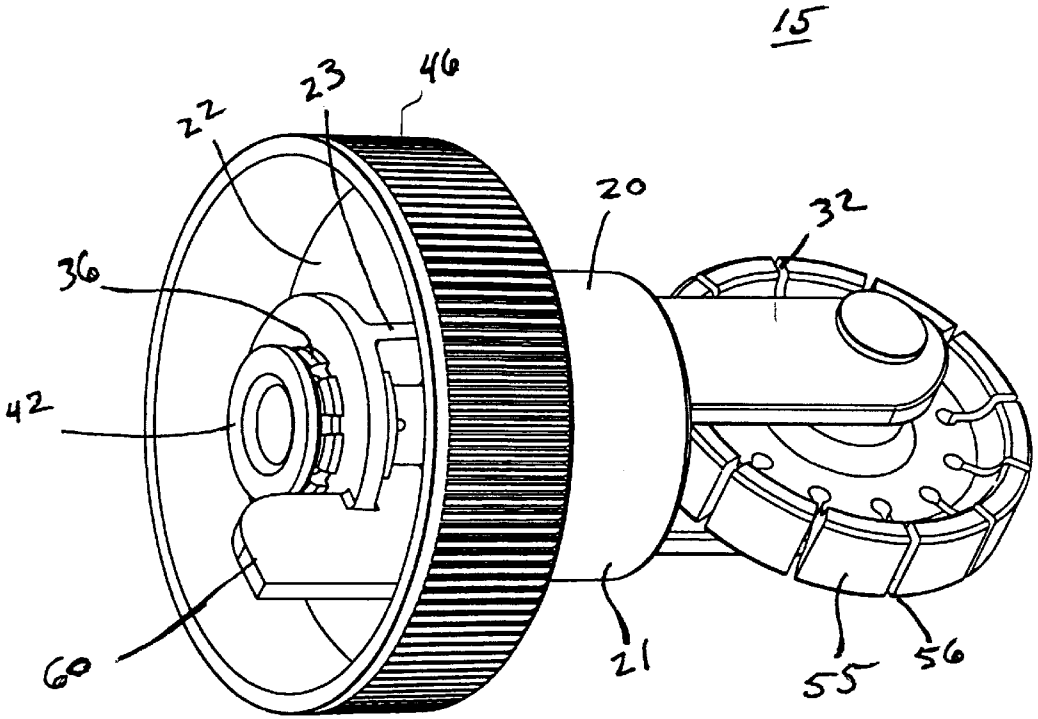
FIG. 3 is an enlarged isometric view of a pressure activated valve used in the applicator of FIG. 1.
Figure 4:
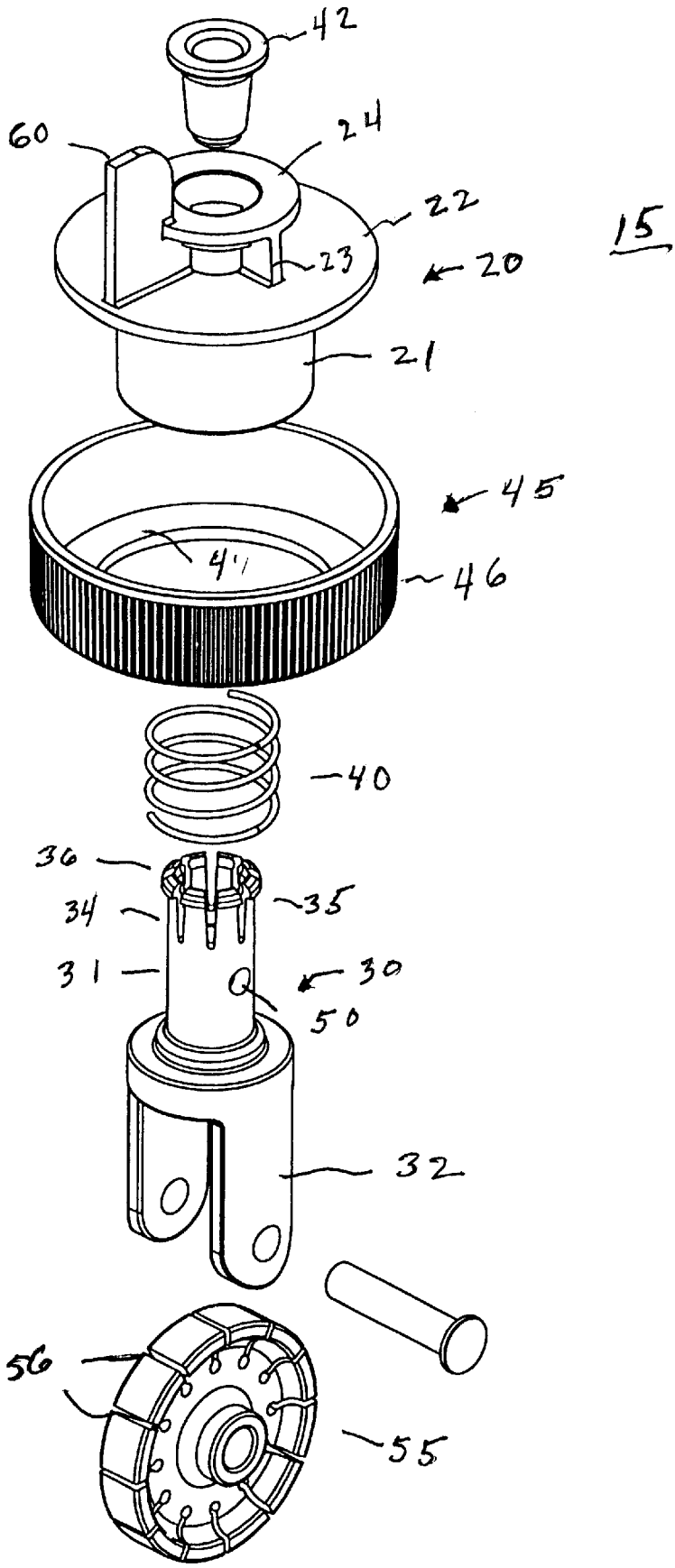
FIG. 4 is an exploded isometric view of the pressure activated valve illustrated in FIG. 3.

Turning now to FIGS. 3 and 4, pressure activated sealer valve 15 is illustrated in more detail. Included in valve 15 is a valve chassis 20 formed with a cylindrical housing 21 having a radially outwardly projecting flange 22 adjacent the upper end thereof. A plurality (three in this embodiment) of axially extending ribs 23 are formed on the upper surface of flange 22 so as to support a mounting ring 24. As can be seen by referring additionally to FIG. 7, valve chassis 20 defines a central axially extending opening through housing 21, flange 22, ribs 23, and mounting ring 24. The opening through chassis 20 is constricted adjacent the upper end to form a liquid sealing surface 37 at the periphery of the opening while the lower portion of the opening is larger and formed to receive a compression spring therein, as will be explained presently.

Valve 15 also includes a wheel fork assembly 30 formed with a hollow cylindrical body 31 bifurcated at the lower end to define a wheel receiving fork 32. Fork 32 extends axially outwardly from the lower end of body 31 to from a flange-like structure for assembly purposes. Body 31 has an upper end 34 with axial slots 35 formed therein and upper end 34 terminates in an axially outwardly extending flange 36. Slots 35 in upper end 34 form upper end 34 into a snap-lock arrangement. The outer diameter of hollow cylindrical body 31 is slightly smaller than the inner diameter of the opening defined by liquid sealing surface 37 of chassis 20 and forms a mating sealing surface. A valve tension (compression) spring 40 is positioned around body 31 with one end bearing against the flange-like structure of fork 32 at the lower end of body 31. Axial slots 35 provide sufficient spring action to allow flange 36 and body 31 to be inserted into the opening in valve chassis 20 so that flange 36 extends above mounting ring 24 and the outer surface of body 31 forms a liquid seal with sealing surface 37 of chassis 20. A plug 42 is inserted axially into the upper end of body 31 so as to engage flange 36 and mount assembly 30 within chassis 20 for limited axial movement.

Figure 6:
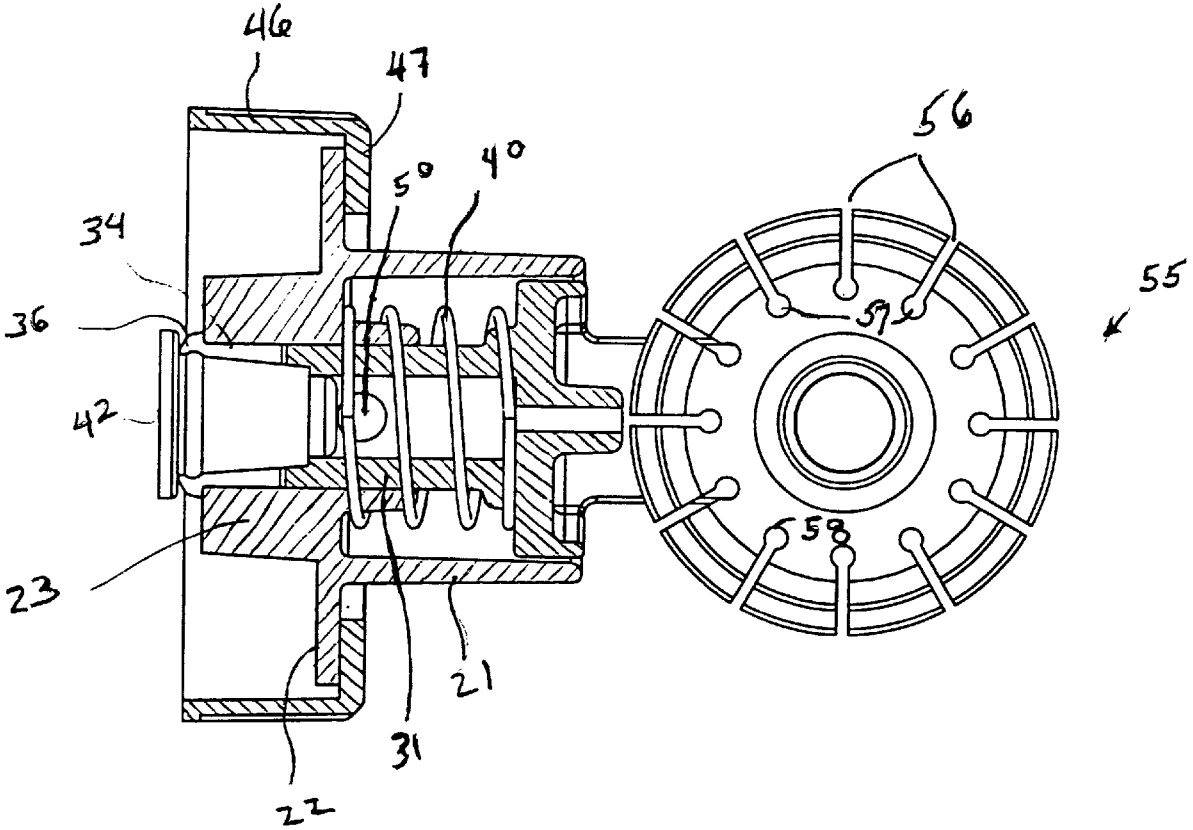
FIG. 6 is a sectional view of the pressure activated valve illustrated in FIG. 3, with the valve in a closed orientation.

A screw ring 45 includes a cylindrical portion 46 with an axially inwardly extending flange 47 formed at the lower end. The inner periphery of cylindrical portion 46 is threaded to engage threads formed on the outer periphery of lower end 16 of body 13. Ring 45 is assembled by inserting fork 32 through the central opening of ring 45 and moving ring 45 axially along chassis 20 and assembly 30 until the upper surface of flange 47 sealingly engages the lower surface of flange 22. With ring 45 threadedly engaged over lower end 16 of body 13, lower end 16 bears against the upper surface of flange 22 of chassis 20 and flange 47 of ring 45 bears against the lower surface of flange 22 to form a liquid tight seal and to fixedly engage pressure activated sealer valve 15 on tubular body 13. Further, the outer surface of hollow cylindrical body 31 sealingly mates with liquid sealing surface 37 of chassis 20 to prevent the flow of liquid sealer out of tubular body 13 when valve 15 is in the closed position (illustrated in FIGS. 3 and 6).

Figure 9:
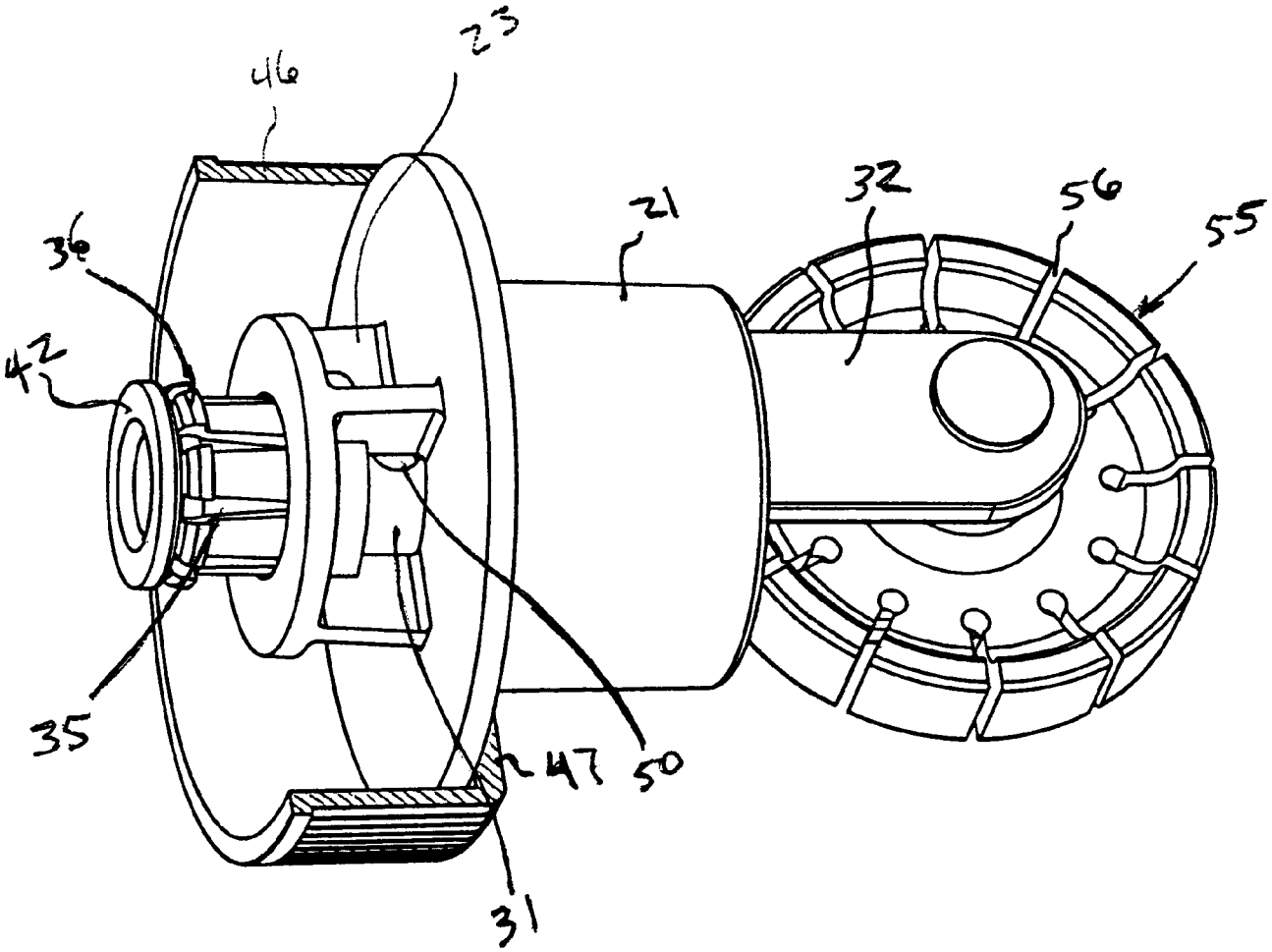
FIG. 9 is an isometric view, portions thereof broken away and shown in section, of the pressure activated valve illustrated in FIG. 3, with the valve in an open orientation.

One or more (in the present embodiment two) openings 50 are formed in hollow cylindrical body 31 so as to extend radially through the wall of body 31, as can be seen best in FIG. 4. Openings 50 are positioned to be oriented below flange 22 and closed by liquid sealing surface 37 when valve 15 is in the closed position (illustrated in FIGS. 3 and 6). When valve 15 is moved to an open position (i.e. spring 40 is compressed), assembly 30 is moved axially upwardly in chassis 20 until openings 50 are oriented above flange 22 and liquid sealer can flow from tubular body 13 through openings 50 (between ribs 23) and into hollow cylindrical body 31. Valve 15 is illustrated in the open position in FIGS. 7 and 9. The axially extending opening through hollow cylindrical body 31 is restricted at the lower end (see FIG. 6) to limit the flow of liquid sealer to a suitable amount, which will become apparent from the following description.

Figure 7:
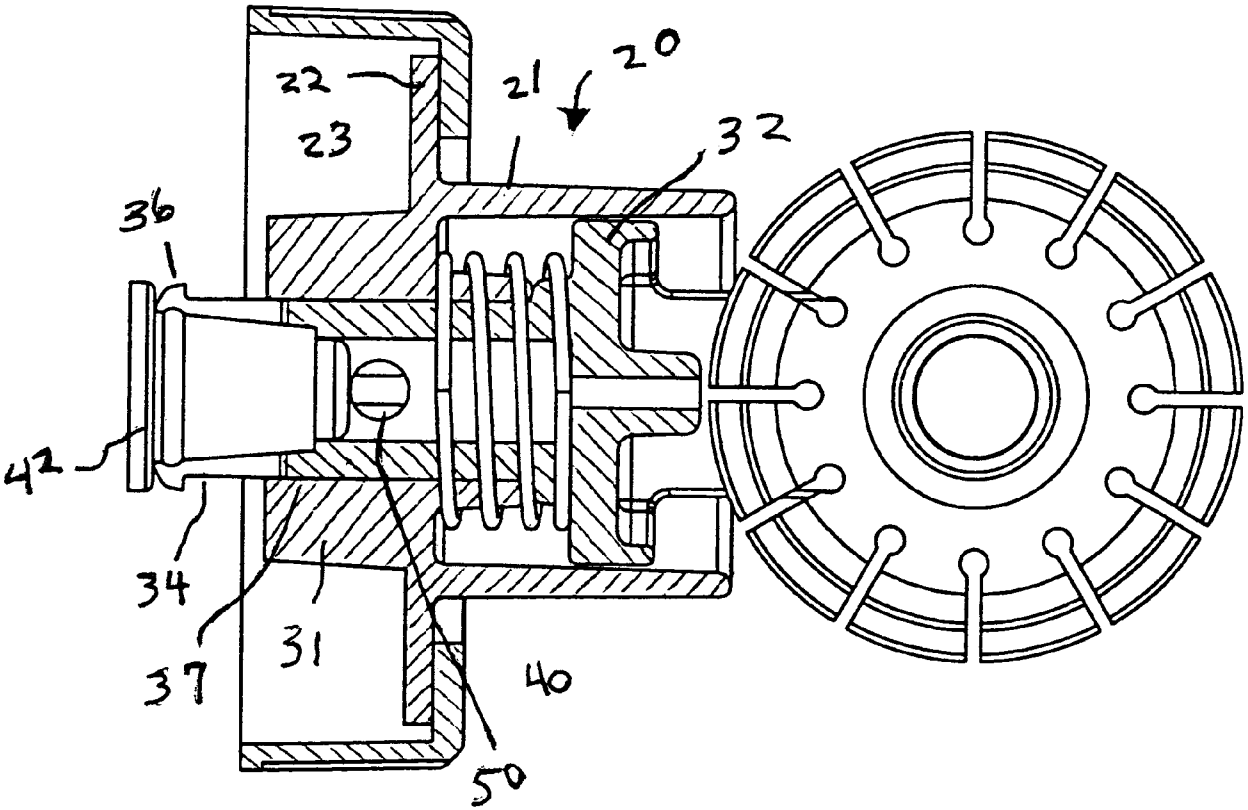
FIG. 7 is a sectional view of the pressure activated valve illustrated in FIG. 6, with the valve in an open orientation.

A sealer distribution or applicator wheel 55 is constructed to be positioned in fork 32 at the lower end of body 31. A wheel axle is inserted through mounting holes in fork 32 and through an axial opening in applicator wheel 55 so as to rotatably mount applicator wheel 55. Regularly spaced, axially extending slots 56 are formed in the periphery of wheel 55 with each slot 56 having an enlarged inner end that operates as a reservoir 57. In this specific embodiment, each slot 56 and associated reservoir 57 is formed sufficiently small to provide capillary action for liquid sealer contained in reservoir 57. Thus, in operation, liquid sealer flows from hollow cylindrical body 31, through the restricted opening at the lower end, and is drawn into each reservoir 57 through an associated capillary slot 56 (as best seen in FIG. 7). At the lower surface of applicator wheel 55, liquid sealant is drawn out of reservoirs 57 through associated capillary slots 56 and evenly distributed onto grout by the outer periphery of wheel 55.

Figure 8:
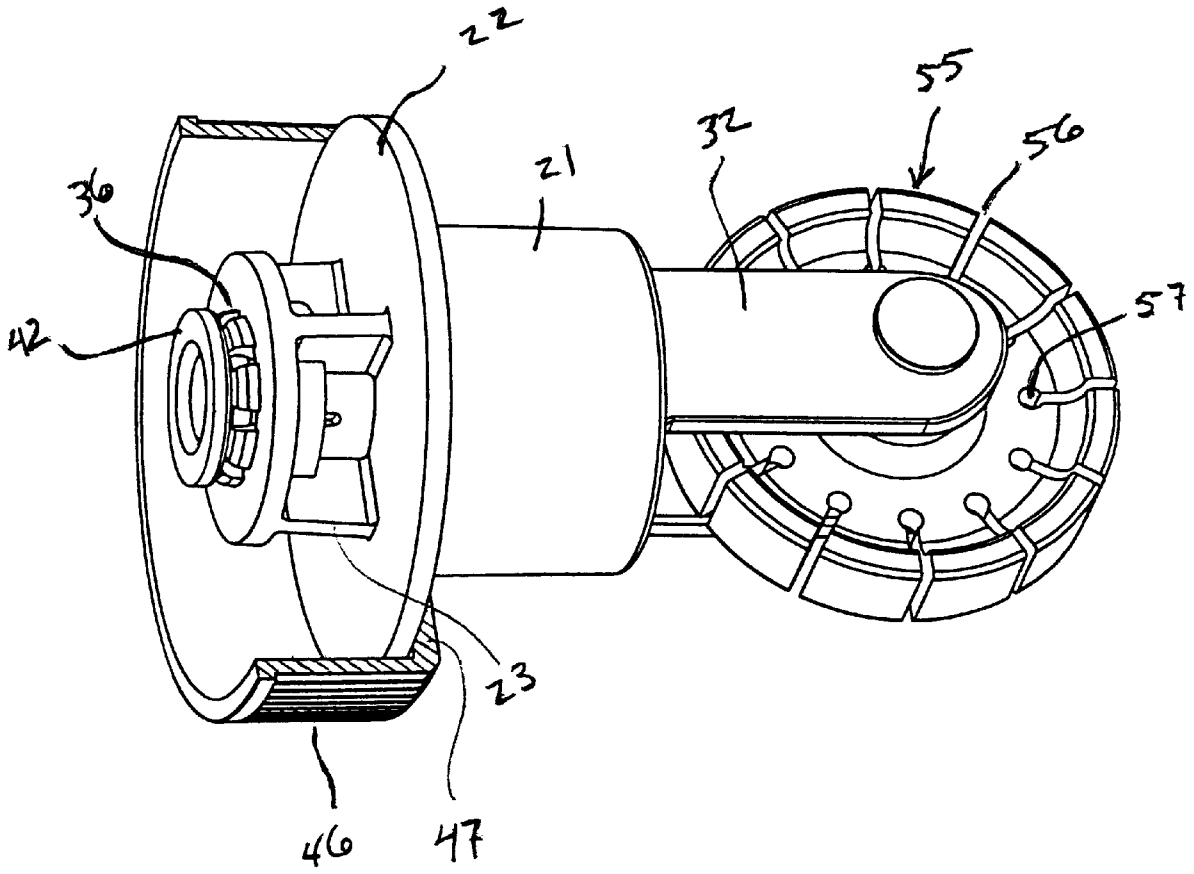
FIG. 8 is an isometric view, portions thereof broken away and shown in section, of the pressure activated valve illustrated in FIG. 3, with the valve in a closed orientation.

Thus, reviewing the overall operation of applicator 10, valve assembly 15 is disengaged from tubular body 13, as shown in FIG. 2, and tubular body 13 is conveniently filled with liquid sealer or the like. Valve assembly 15 is then threadedly engaged onto lower end 16 of tubular body 13, as illustrated in FIG. 1. To apply the sealer to grout on a floor or the like, applicator wheel 55 is positioned on the grout and the operator releases sealer by pressing downwardly on handle 11 to move valve assembly 15 from the closed position (illustrated in FIGS. 6 and 8) into the open position (illustrated in FIGS. 7 and 9). While pressing downwardly on handle 11 to move valve assembly 15 from the closed position into the open position, the operator rolls applicator wheel 55 along a line of grout, which causes sealer to flow from tubular body 13 through valve assembly 15 and onto wheel 55. As explained above, the sealer flows into reservoirs 57 at the top of applicator wheel 55 and out of reservoirs 57 at the bottom of applicator wheel 55 to evenly distribute the sealer over the surface of the grout. When downward pressure on handle 11 is removed, spring 40 biases valve 15 into the closed position and no more sealer is distributed.

Here it should be noted that applicator wheels having different widths can be easily installed in fork 32 so that different widths of grout can be easily and conveniently sealed. Further, the restricted opening at the lower end of hollow cylindrical body 31 can be formed larger or smaller to allow different amounts of sealer to flow onto applicator wheel 55, depending upon the size of applicator wheel 55 and the desired thickness of sealer on the grout. To this end, the restricted opening at the lower end of hollow cylindrical body 31 can be formed so as to be adjustable, or different valves 15 can be easily used with various applicator wheels 55.

Figure 5:
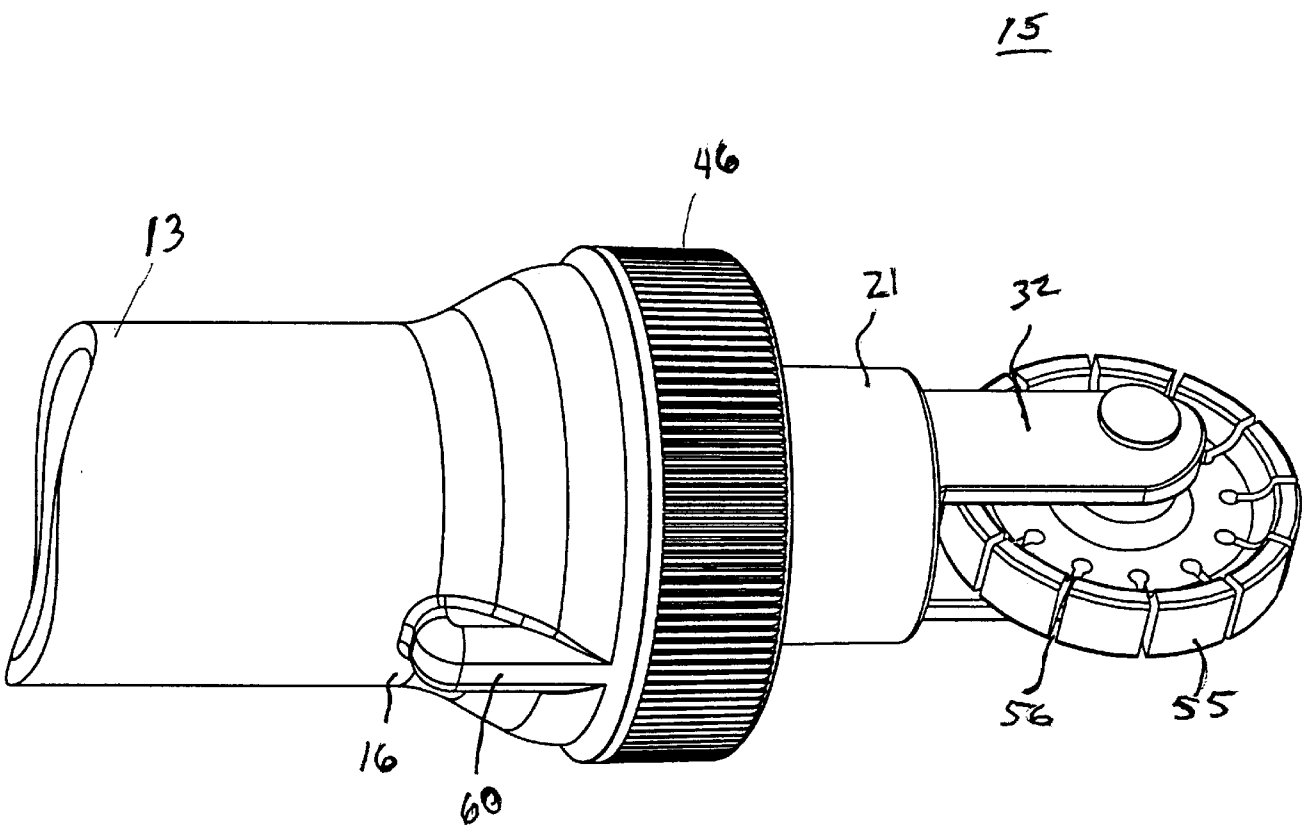
FIG. 5 is an enlarged isometric view of the pressure activated valve of FIG. 3 assembled with the body, portions thereof broken away and shown in section.

In one embodiment, a roller alignment fin 60 is provided, e.g. by extending the size of one or more axially extending ribs 23. As can be seen in FIG. 5, fin 60 mates with a projection 61 formed in lower end 16 of tubular body 13. Fin 60 is optionally included to position or align wheel 55 with handle 11 so that applicator 10 can be disassembled for filling and/or cleaning and can be quickly and easily reassembled for use without the necessity of considering the alignment of wheel 55 with handle 11.

Thus, a new and improved applicator for a liquid grout sealer has been disclosed, which is easy and efficient to use and which provides a uniform and clean application of grout sealer. The new and improved applicator for liquid grout sealer includes a built in reservoir of sealer which is easy to use and which can be distributed uniformly. Further, the new and improved applicator for liquid grout sealer can quickly and easily be adapted to seal various widths of grout and to provide various uniform thickness of sealer on the grout. The new and improved applicator for liquid grout sealer provides adequate channeling of the sealer from a reservoir without dripping and puddling and can be easily disassembled for filling and/or cleaning.

Various changes and modifications to the embodiments herein chosen for purposes of illustration will readily occur to those skilled in the art. To the extent that such modifications and variations do not depart from the spirit of the invention, they are intended to be included within the scope thereof that is assessed only by a fair interpretation of the following claims.

Having fully described the invention in such clear and concise terms as to enable those skilled in the art to understand and practice the same, the invention claimed is:

1. An applicator for a liquid grout sealer comprising:

an elongated tubular body defining a sealer reservoir;

a sealer valve at an end of the tubular body including a spring normally biasing the sealer valve into a closed position and pressure activated by axial pressure on a wheel fork coupled to the sealer valve moving the sealer valve into an open position against the bias of the spring; and an applicator wheel carried by the wheel fork for receiving sealer from the reservoir through the sealer valve in the open position and for distributing sealer.

2. An applicator for a liquid grout sealer as claimed in claim 1 wherein the sealer valve includes a restricted sealer dispensing opening adjacent the applicator wheel for dispensing sealer onto an outer periphery of the applicator wheel.

3. An applicator for a liquid grout sealer as claimed in claim 2 wherein the applicator wheel includes a plurality of regularly spaced axially extending slots in the periphery.

4. An applicator for a liquid grout sealer as claimed in claim 3 wherein the regularly spaced axially extending slots extend radially inwardly into the wheel and are sized to promote capillary action.

5. An applicator for a liquid grout sealer as claimed in claim 4 wherein each of the slots terminates in a reservoir.

6. An applicator for a liquid grout sealer comprising:

an elongated tubular body defining a sealer reservoir;

a sealer valve removably coupled to an end of the tubular body permitting filling of the sealer reservoir with sealer, the sealer valve including a spring normally biasing the sealer valve into a closed position and pressure activated by axial pressure on a wheel fork coupled to the sealer valve moving the sealer valve into an open position against the bias of the spring;

an applicator wheel carried by the wheel fork for receiving sealer from the reservoir through the sealer valve in the open position and for distributing sealer; and the sealer valve having a restricted sealer dispensing opening adjacent the applicator wheel for dispensing sealer onto an outer periphery of the applicator wheel.

7. An applicator for a liquid grout sealer as claimed in claim 6 wherein the applicator wheel includes a plurality of regularly spaced axially extending slots in the periphery.

8. An applicator for a liquid grout sealer as claimed in claim 7 wherein the regularly spaced axially extending slots extend radially inwardly into the wheel and are sized to promote capillary action.

9. An applicator for a liquid grout sealer as claimed in claim 8 wherein each of the slots terminates in a reservoir.

* * * * *